US005711323A

United States Patent [19]

Denebeim

[11] Patent Number: 5,711,323

[45] Date of Patent: Jan. 27, 1998

[54] SPHERICAL HAIR STYLING DEVICE

[76] Inventor: Sabrina Denebeim, 260 Avila St., San Francisco, Calif. 94123

[21] Appl. No.: 644,616

[22] Filed: May 1, 1996

Related U.S. Application Data

[63] Continuation-in-part of Ser. No. 363,256, Dec. 23, 1994, Pat. No. 5,515,874.

[51] Int. Cl.[6] ..... A45D 1/04

[52] U.S. Cl. ..... 132/232; 132/229; 132/227; 132/269; 132/271; 219/225

[58] Field of Search ..... 132/118, 162, 132/163, 232, 269, 271, 272, 227, 229; 219/222, 225, 226

[56] References Cited

U.S. PATENT DOCUMENTS

| | | | |
|---|---|---|---|
| D. 242,963 | 1/1977 | Glasberg . | |
| 750,357 | 1/1904 | Gibbons . | |
| 1,362,892 | 12/1920 | Pace | 132/118 |
| 4,166,472 | 9/1979 | Battaglia . | |
| 4,222,398 | 9/1980 | Fromman . | |
| 4,291,714 | 9/1981 | Mariani . | |
| 4,877,942 | 10/1989 | Raab | 132/232 |
| 4,911,185 | 3/1990 | Losenno . | |
| 4,939,340 | 7/1990 | Brill | 132/232 |
| 4,953,574 | 9/1990 | Tsuji et al. | 132/232 |
| 5,054,153 | 10/1991 | Silliman . | |
| 5,353,463 | 10/1994 | Bracy, Jr. . | |

*Primary Examiner*—Gene Mancene
*Assistant Examiner*—Pedro Philogene
*Attorney, Agent, or Firm*—Majestic, Parsons, Siebert & Hsue

[57] ABSTRACT

A spherical hair styling device and method for using same are provided to enable a user to obtain a helical curl having a continuum of varying diameters within each lock of curled hair. This varying diameter helix provides a new and distinct look for the curled hair. The spherical hair styling device may include either a curling iron or hairbrush having a spherical head. The spherical configuration of the curling iron provides for less wasted space on the curling iron, and allows the curling iron to be more completely utilized for each respective lock of hair which is curled.

6 Claims, 5 Drawing Sheets

SPHERICAL HAIR STYLING DEVICE

This is a continuation-in-part of application Ser. No. 08/363,256, filed Dec. 23, 1994, herein referred to as the "Parent Application ", now U.S. Pat. No. 5,515,874.

BACKGROUND OF THE INVENTION

This invention relates generally to personal grooming devices, and more particularly to devices useful for hairstyling and for curling locks of hair.

Many persons with straight hair wish to temporarily alter their hairstyle through techniques such as curling, blow-drying, ironing, and/or perming. It has been customary in grooming hair to roll a tress or a plurality of strands of hair on a cylindrical curler or curling iron and to apply heat and/or a moistening agent to the hair. The hair is left in its rolled state until it has dried and set. Typically, for curling iron applications, the shaft of the curling iron is heated to a high temperature, which causes the hair to set quickly. After the hair has set, the cylindrical curler(s) or curling iron is removed and the hair retains a curl or wave imparted by the cylindrical curler or curling iron.

However, the curl imparted by a typical cylindrical curler or curling iron is limited to the constraints of a constant diameter roller (of the curler) or the constant diameter shaft of the curling iron. The resultant lock of hair which has been curled using this technique forms a helical shape having a relatively constant diameter. Small diameter cylindrical rollers or shafts produce small helixes and large diameter cylindrical rollers or shafts produce large helixes. Additionally, much of the space on the cylindrical curler or curling iron is wasted because a majority portion of each lock of hair is rolled around the center portion of the curler or curling iron, leaving the end portions of the curler or curling iron unused and visually devoid of hair.

It is therefore an object of the present invention to overcome the disadvantages associated with conventional cylindrical curlers or curling irons, and to provide a novel hairstyling technique for styling hair into shapes which cannot be achieved using conventional cylindrical curlers or curling irons.

SUMMARY OF THE INVENTION

This and additional objects of the present application are accomplished by the various aspects of the present invention, wherein briefly, according to a principal aspect, a hair styling device is provided with a spherically-shaped head to enable a user to obtain a helical curl having a continuum of varying diameters within each lock of curled hair. This varying diameter helix provides a new and distinct look for the curled hair. In addition, the spherical configuration of the head of the hair styling device provides for less wasted space, and allows the full head of the hair styling device to be more completely utilized for each respective lock of hair.

According to a first aspect of the present invention, a hairstyling device is provided which includes a curling iron having a handle and a substantially spherical head. The curling iron further includes a hair retaining member pivotally attached to the curling iron. The hair retaining member is releasably engagable with the head of the curling iron for securing a portion of hair between the hair retaining member and the curling iron head. The hair retaining member includes an elongated finger-like distal end portion having a curved configuration which conforms with the shape of the head.

According to a second aspect of the present invention, a hairstyling device is provided which includes a hairbrush having a handle, a substantially spherical brush head, and a plurality of bristles radiating from the brush head.

The ball-shaped curling iron of the present invention is able to curl the hair into helical-shaped curls of varying diameters instead of cylindrical-shaped curls obtained from conventional, cylindrical curling irons. The present invention makes it easier for the user to create curls in the back of the head. It also allows the user to do fuller, more convenient curling that flips upwards, and creates rounder, uniquely-shaped curls. The curls obtained using the ball-shaped curling iron of the present invention provide more fullness at the root of the hair because of the rounded shape of the curling head. Additionally, the curling iron of the present invention fits the head better because the ball-shape of the curling iron conforms to the round shape of the human head.

Additional objects, features and advantages of the various aspects of the present invention will become apparent from the following description of the preferred embodiment, which description should be taken in conjunction with the accompanying drawings.

DETAILED DESCRIPTION OF THE PREFERRED EMBODIMENT

Figure 1A:
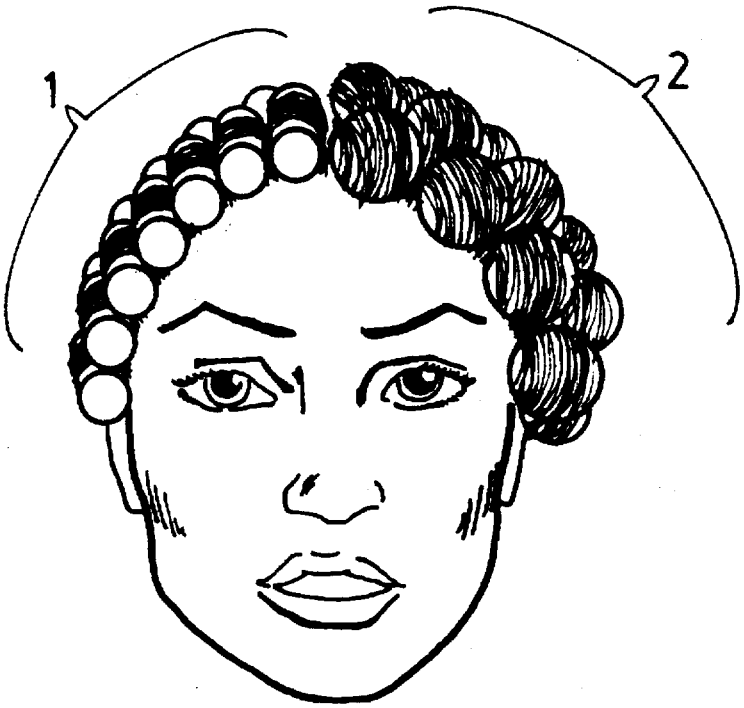
FIG. 1A shows a front view of a person using conventional curlers i on the left side of her head and using the spherical curlers 2 of the Parent Application on the right side of her head.

FIG. 1A is a frontal view of a person with conventional curlers i on the left side of her head (as viewed by the viewer), and spherical curlers 2 on the right side of her head. Although the spherical curlers 2 in FIG. 1A are depicted as all being the same size, it is to be understood that the spherical curler of the Parent Application may be manufactured in a variety of sizes, each of which is available to a user to be used as shown in FIG. 1A. Thus, spherical curlers of differing sizes may be used during a particular hairstyling session.

The unique spherical shape and different sizes of the curler of the Parent Application also allows the user to apply more curlers to a given area of the scalp (or other desired portions of the head). This, in turn, allows a user to increase the actual amount of curls within a given area. The ability to increase the amount of curls creates a unique "maxi "curl style which heretofore has not been possible using conventional, cylindrical curlers. Moreover, the very act of winding hair around the outer surface of the spherical curler itself induces the unique, full bodied, hair style, which is described in greater detail below.

Figure 1B:
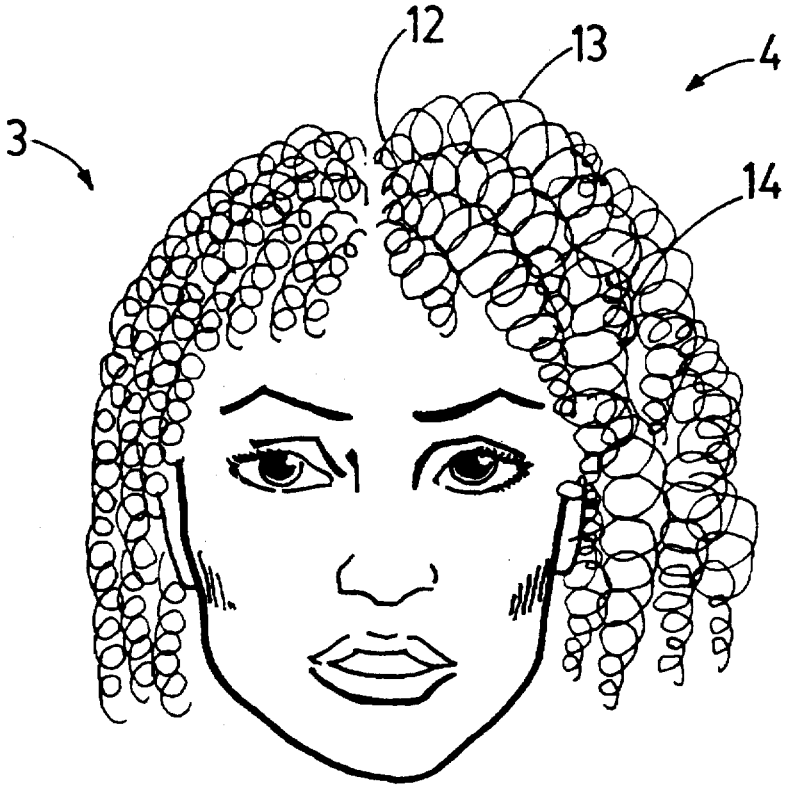
FIG. 1B illustrates the person's hair of FIG. 1A after the curlers have been removed, showing curls 3 resulting from conventional curlers and showing curls 4 resulting from the spherical curlers of the Parent Application.

FIG. 1B illustrates the various resulting curls which form using the different types of curlers shown in FIG. 1A. It is to be noted that the curls shown in FIG. 1B are for illustrative purposes, and are intended to exemplify the differences between curls obtained from conventional cylindrical curlers and curls obtained from the spherical curler of the Parent Application.

Curls generally depicted at 3 result from the conventional curlers 1 of FIG. 1A. A closer inspection of the curls 3 reveals that the conventional curler produces curls in a helical shape, wherein each of the curls in the helix has substantially the same diameter. This is the result of the hair being wrapped around a cylindrical curler which has a single diameter.

In contrast, the curls shown generally at 4 in FIG. 1B result from using the spherical curler of the Parent Application, as shown in FIG. 1A. Because different portions of hair are wrapped around a single spherical curler at different locations on the curler, the diameter of the resulting curls will vary, depending upon the diameter portion of the spherical curler onto which each part of hair is wound. The curls 4 which result using the spherical curler of the Parent Application retain a helical shape with a continuum of differing diameters. For example, as shown in FIG. 1B, the resulting curls 4 start out having a small diameter 12, then progresses to a larger diameter 13, and again reduce to a smaller diameter 14. Thus, the use of a spherical curler provides the unexpected advantage of producing a helical curl with a continuum of differing diameters, as shown generally at 4 in FIG. 1B.

In the Parent Application, a spherical curler is described which enables the hair to be styled into a unique helical shape, attributable to the spherical shape of the curler. In the present application, the advantages associated with a spherically shaped hair styling device have been applied to the field of hair curling irons and hair brushes. Thus, as described below, many of the advantages which result from using the spherical curler of the Parent Application can also be achieved using the spherical curling iron or spherical hair brush embodiments described in the present application.

It is to be noted that, while the discussion below pertains primarily to the spherical curling iron embodiment of the present invention, the uses and advantages of the spherical hair styling device of the present invention described herein is equally applicable to the spherical hairbrush embodiment of the present invention.

Figure 2:
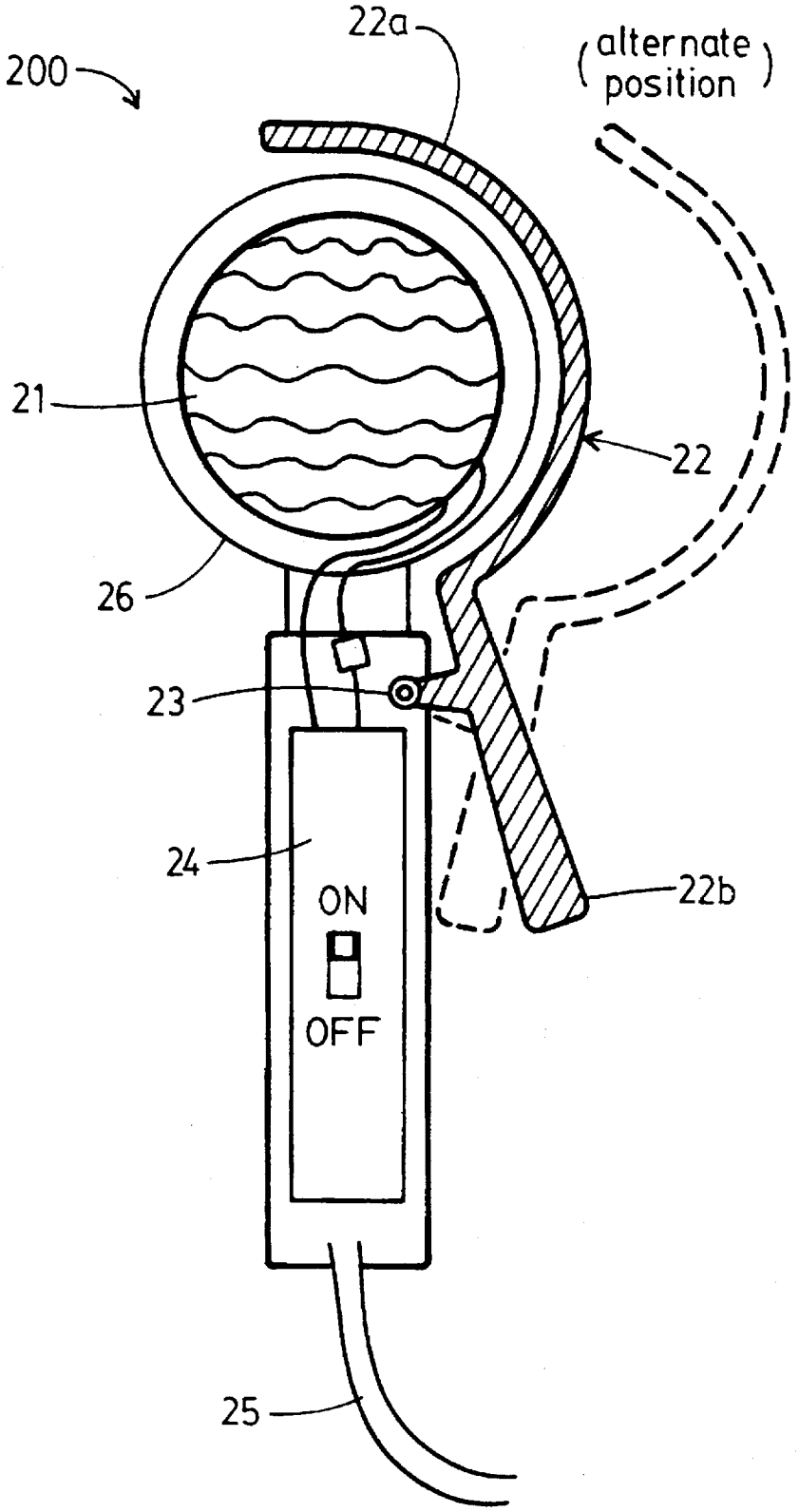
FIG. 2 illustrates a front view of the spherical curling iron 200 of the present invention.

FIG. 2 illustrates a frontal view of the spherical curling iron 200 of the present invention. Like the spherical curler of the Parent Application, the spherical curling iron 200 may be used to create a unique hair style, wherein helical curls are produced with a continuum of differing diameters, as shown generally at 4 in FIG. 1B.

Referring to FIG. 2, it can be seen that the spherical curling iron 200 of the present invention comprises a handle portion 24 and a head portion 26. The head portion 26 has a substantially spherical shape. Disposed within the head of the curling iron is a heating element 21 for providing thermal heat to the external surface of the curling iron head. The heating element may comprise any one of a number of conventional heating means such as, for example, a resistive electric element or an internal gas burning element. The curling iron may also be heated, for example, by exposing it to a stream of warm or hot air. Once the hair is wrapped around the curling iron, the heat radiated by the head portion will radiate outward in a manner similar to that of conventional, cylindrical hot curling irons. The material forming the external surface of the curling iron head may be formed from any one of a number of conventional materials such as, for example, metal or high-temperature plastic.

Figure 3:
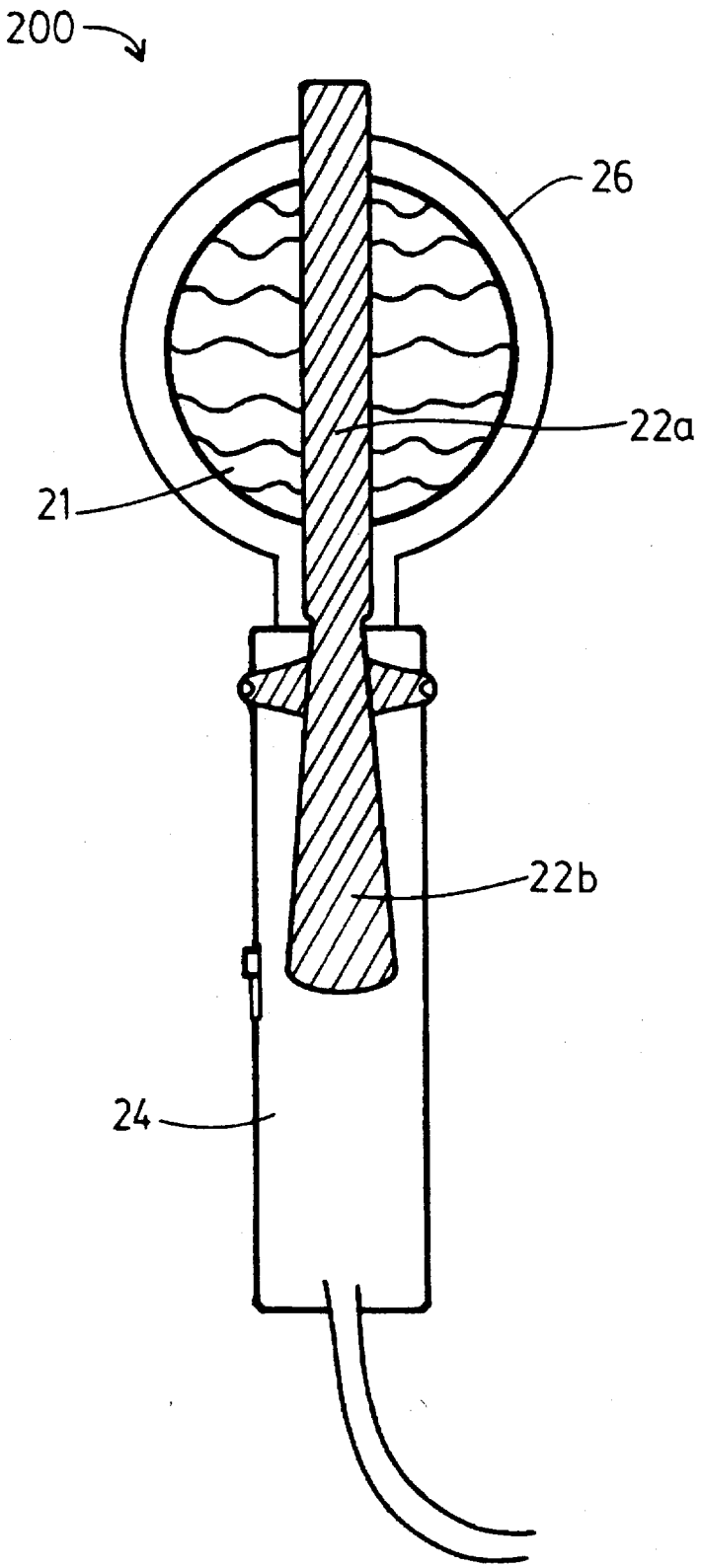
FIG. 3 illustrates a side view of the spherical curling iron 200 of the present invention.

Additionally, as shown in FIG. 2, the curling iron 200 of the present invention also includes a hair retaining member 22 which is pivotally attached to the curling iron so as to allow it to releasably engage with the head 26 for securing a portion of hair between the hair retaining member 22 and head 26. The hair retaining member includes an elongated distal end portion **22*a* having a curved configuration that conforms with the shape of head 26. As shown in FIG. 3, it is preferable that the elongated distal end portion 22*a* have a narrow width so as to maximize the available external surface area of head 26. Thus, by minimizing the width of the distal end portion 22*a* of hair retaining member 22, more hair is able to contact the external surface of head 26** as it is wrapped around the curling iron head and hair retaining member.

As shown in FIG. 2, for example, the hair retaining member 22 is pivotally attached to the curling iron at pivot 23. Although pivot 23 is shown attached to the handle portion 24, it is also possible for the pivot to be attached to head portion 26. In its normal state, the hair retaining member 22 is forcibly engaged against head 26 by a tension means such as, for example, a spring (not shown). When the bottom portion **22*b* of the hair retaining member is depressed, the distal portion 22*a* of the hair retaining member moves away from head 26, as shown in phantom in FIG. 2. A lock or tuft of hair is then placed in-between head 26 and hair retaining member portion 22*a*. When bottom portion 22*b* is released, hair retaining member 22 secures the lock or tuft of hair against head 26. The remaining portion of the lock of hair is then rolled upon head 26**, and allowed to set for a period of time.

The spherical hair curling iron 200 of the present invention may be used in a manner similar to that of conventional curling irons. However, due to the unique spherical shape of the curling iron head 26, the resultant hair style will have a unique helical, full body shape which cannot be produced using convention, cylindrical-shape curling irons.

The spherical curling iron of the present invention also makes it easier for the user to create curls in the back of the head. This is because the spherical shape of the curling iron tends to fit the rounded shape of the human head better. In addition, the spherical curling iron allows the user to do fuller, more convenient curling that flips upwards and form rounder, uniquely-shaped curls.

Furthermore, the spherical shape of the head of the curling iron permits more localized attention to hair at a particular point on the head. This results in the spherical curling iron being able to provide more fullness at the root of the hair because of the rounded shape of the curling iron. A cylindrical curling iron, on the other hand, forces the user to curl hair along a linear axis, which distributes the hair away from the root and reduces the effectiveness of the hair styling device.

Moreover, like the curlers of the Parent Application, the spherical curling iron of the present invention provides for less wasted space on the curling iron. That is, nearly all of the surface area of the spherical curling iron is able to be utilized for shaping hair, due to the spherical shape of the curling iron. In contrast, conventional cylindrical shaped curling irons, like conventional curlers, utilize only a portion of the curling iron for styling hair, with a large portion of the curling iron being unused. Additionally, as described in the Parent Application, it is easier to roll hair around a spherical shape than it is to roll hair around a cylindrical shape.

Like the spherical curlers of the Parent Application, the unique shape of the spherical curling iron allows for a variety of differing techniques for curling and styling hair which heretofore have not been possible using conventional, cylindrical curling irons. For example, because of the spherical shape of the curling iron, the hair is able to be wound around the curling iron in a plurality of directions.

Conventionally, cylindrical curling irons are only able to rotate about a single axis of rotation, wherein the hair is wound in a single direction starting from its end, and continuing up until the cylindrical curling iron reaches the scalp. Thus, conventional cylindrical curling irons only permit hair to be wound and unwound along a relatively uni-directional path, as defined by the curling irons' longitudinal axis of rotation.

In contrast, the spherical shape of the hair styling device of the present invention permits the curler to be rotated along a virtually unlimited number of axes of rotation. Thus, rather than being constrained to merely rolling the curling iron up and back along a uni-directional path, the spherical curling iron of the present invention may be wound in any number of directions. Furthermore, the rotational direction of the curling iron may be changed while a lock of hair is being wound upon it. Thus, for example, a first portion of a lock of hair may be wound by rotating the spherical curling iron about a first axis of rotation and, after the lock of hair has been partly wound about the curling iron, the curling iron may then be rotated along a second and different axis of rotation until the remaining portion of that lock of hair has been completely wound upon the curling iron. Such a technique for winding hair upon a spherical curling iron allows for the unexpected advantage of enabling a user or hairstylist to create a plurality of new and different hairstyles which cannot be created using conventional, cylindrical curling irons. It is to be noted that the above-described hair styling technique may also be applied to the spherical hairbrush of the present invention as well.

In the embodiment shown in FIGS. 2 and 3, exterior head portion 26 should preferably be made of a material which can withstand high temperatures such as, for example, high temperature plastic or metal. Additionally, the head of the curling iron should preferably be made of a lightweight, thermally conductive material so that the user does not experience an undue burden of weight on his or her head while the curling irons are setting the hair.

Additionally, although not illustrated, the spherical curling iron 200 may also include a plurality of tiny prongs (or protrusions) on the outer surface of its head 26 in order to help the hair catch onto the curling iron during winding.

Figure 4A:
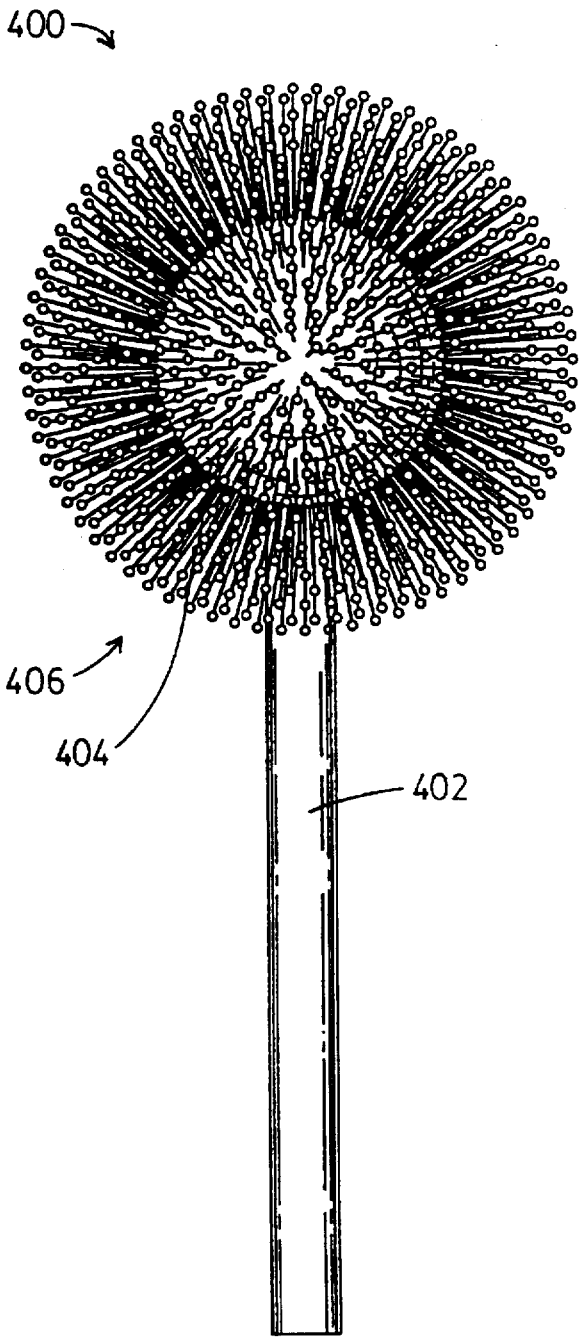
FIGS. 4A–4C illustrate one embodiment of the spherical hairbrush 400 of the present invention.
Figure 4B:
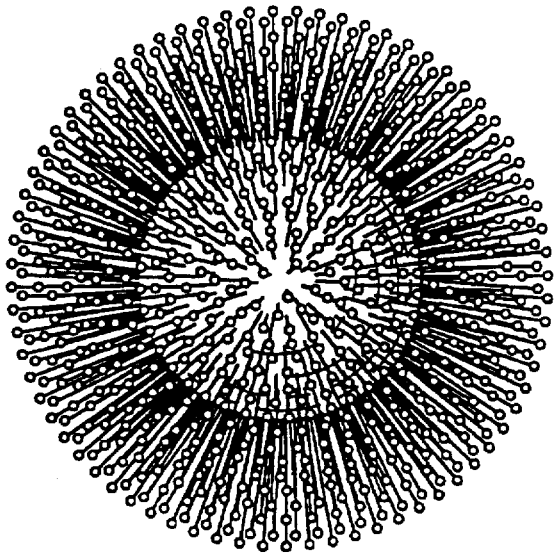
Figure 4C:
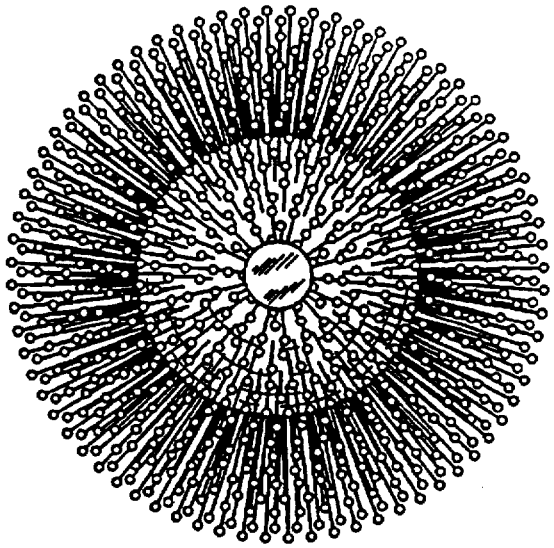

FIGS. 4A–4C illustrate one embodiment of the spherical hairbrush 400 of the present invention. FIG. 4A illustrates a frontal view of hairbrush 400. FIG. 4B illustrates a top view of hairbrush 400, and FIG. 4C illustrates a bottom view of hairbrush 400. As shown in FIG. 4A, hairbrush 400 comprises a handle 402, and a spherical brush head 404. Radiating out from the spherical brush head are a plurality of bristles 406.

Figure 5A:
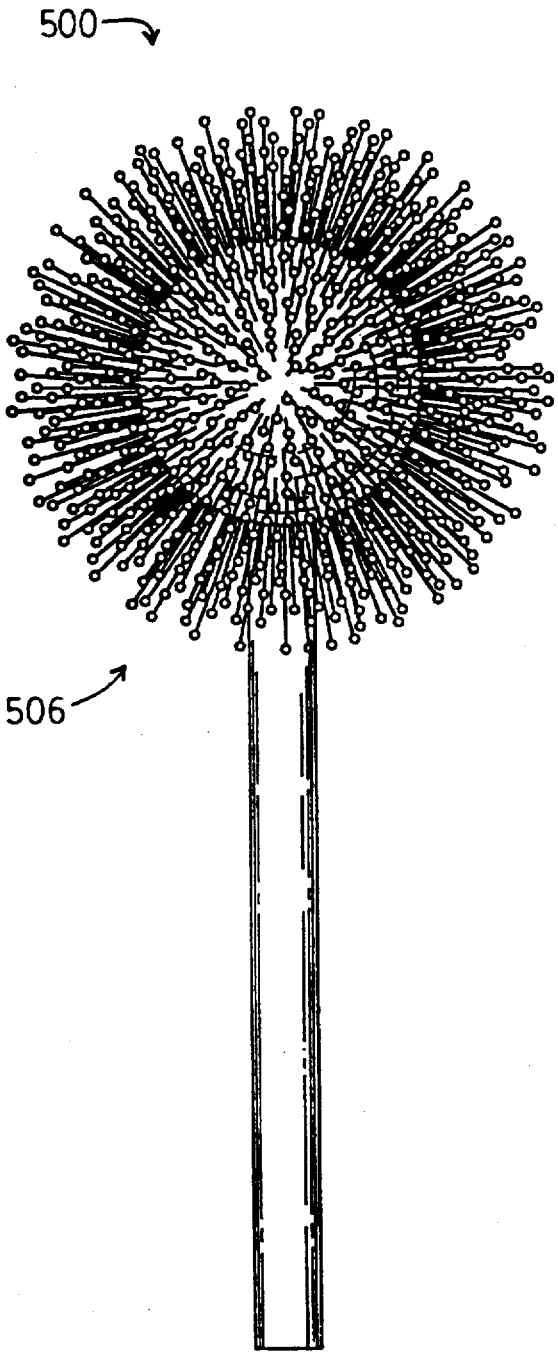
FIGS. 5A–5C illustrate an alternate embodiment of the spherical hairbrush 500 of the present invention.
Figure 5B:
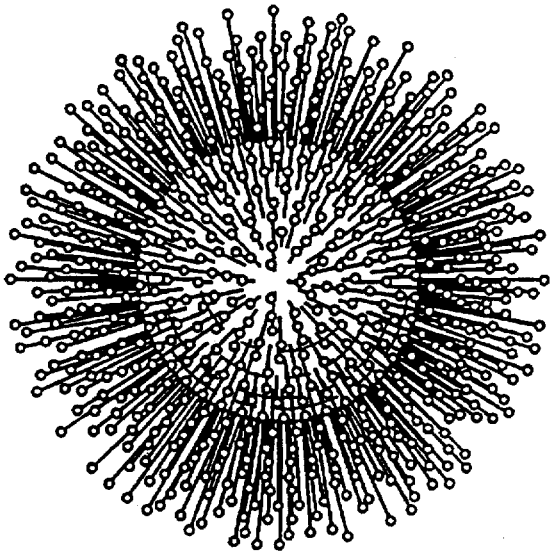
Figure 5C:
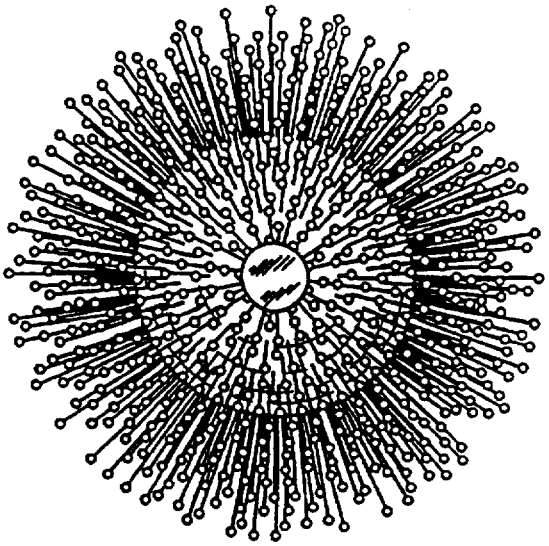

FIGS. 5A–5C illustrate an alternate embodiment of the spherical hairbrush 500 of the present invention. FIG. 5A illustrates a frontal view of hairbrush 500. FIG. 5B illustrates a top view of hairbrush 500, and FIG. 5C illustrates a bottom view of hairbrush 500. One difference between hairbrush 400 and hairbrush 500 is the bristles 406 of hairbrush 400 are substantially the same length, while the bristles 506 of hairbrush 500 are of differing lengths.

The use and advantages of the spherical hairbrush of the present invention are similar to those described above with respect to the spherical curling iron of the present invention. Furthermore, the hairstyling advantages obtained by using the spherical hairbrush of the present invention are also similar to the advantages described in the Parent Application with respect to the spherical curler, and therefore will not be repeated.

It is to be noted, however, that conventional hairbrushes are unable to provide the advantages and/or hair styling shapes obtained by using the spherical hairbrush of the present invention. Additionally, the unique shape of the spherical brush head of the present invention in combination with a hair-gripping bristle design as shown, for example, in FIGS. 4 and 5 allows the hairbrush of the present invention to be used in a manner which can not be duplicated using conventional, cylindrical hair brushes.

For example, a user using the hairbrush 400 shown in FIG. 4 of the drawings is able to wind a lock of hair around the spherical brush head of the hairbrush, and is then able to continue to wind or rotate the hairbrush while simultaneously moving the position of the brush head to another portion of the scalp to thereby cause an additional section of hair to be wound upon the hairbrush while the previous section of hair is shaped and released.

Starting from the top portion of the brush head, there is a continuum of circles of bristles which gradually increase in diameter until the middle portion of the brush head is reached. As the hairbrush is rotated and moved laterally, this continuum of increasing circles of bristles acts as a spiral or corkscrew which initially grabs the hair at the top portion of the brush head, winds the hair around the middle portion of the brush head, and eventually releases the hair at the bottom portion of the brush head.

Due to the unique shape of the spherical brush head of the present invention, the diameter of the circle of bristles at the top portion of the brush head is smaller than the diameter of the circle of bristles at the middle portion of the brush head. As the hairbrush is rotated and simultaneously moved across a portion of the scalp such as, for example, the bang area where the hairline meets the forehead, the smaller circle of hair-gripping bristles initially grabs the hair and wraps the hair around the body of the brush head. As the hairbrush is continually rotated and moved laterally along the hairline, the spiralling effect of the bristles causes each portion of hair to be wrapped around the middle portion of the spherical brush head and ultimately released at the bottom portion of the brush head. Simultaneously, new locks of hair are continually being grabbed by the bristles at the top portion of the brush head and spiralled inward towards the middle section. Using this technique, it is possible to style hair both quickly and conveniently and obtain fuller, richer curls as compared to hairstyling techniques using conventional, cylindrical hairbrushes. Moreover, conventional hairbrushes are not able to provide the hair spiraling function that is achievable using the spherical hairbrush of the present invention in combination with hair-gripping bristles.

Additionally, the spherical shape of the brush head of the present invention permits a user to continuously rotate the brush head even after an entire lock of hair has been wound around the brush head. This is also true for the spherical curling iron embodiment of the present invention. That is, the spherical curling iron may be continually rotated even after an entire lock of hair has been wound around the curling iron. As the spherical hairstyling device is continually rotated, the lock of hair which is wrapped around the device is allowed to slip, and, because of its spherical shape, the top and bottom portions of the spherical brush or curling iron head taper away from the middle section where the brush or curling iron head meets the scalp. This tapering effect allows hair which has been wrapped around the brush or curling iron head to easily slip away and/or release itself from the head of the hairstyling device. With conventional, cylindrical hairbrushes or curling irons, however, once the hair has been completely wound upon the shaft or head of the brush or curling iron, the brush or curling iron is not able to be rotated further without pulling the hair.

Although several preferred embodiments of this invention have been described in detail herein with reference to the accompanying drawings, it is to be understood that the invention is not limited to these precise embodiments, and that various changes and modifications may be affected therein by one skilled in the art without departing from the scope or spirit of the invention as defined in the appended claims.

What is claimed is:

1. A hair curling iron comprising:

a handle;

a head attached to said handle, said head having a substantially spherical shape; and a hair retaining member pivotally attached to said curling iron and releasably engagable with said head for securing a portion of hair between said hair retaining member and said head.

2. The curling iron of claim 1 wherein said hair retaining member includes an elongated (finger-like) finger-shaped distal end portion having a curved configuration which conforms with the shape of said head.

3. The device of claim 1 further comprising a heating element disposed within said head.

4. A hair styling device comprising:

a handle;

a head attached to said handle, said head having a substantially spherical shape.

5. The hair styling device of claim 4 further comprising:

a hair retaining member pivotally attached to said device and releasably engagable with said head for securing a portion of hair between said hair retaining member and said head; and a heating element disposed within said head.

6. The device of claim 5 wherein said hair retaining member includes an elongated (finger-like) finger-shaped distal end portion having a curved configuration which conforms with the shape of said head.

* * * * *